US008641266B2

(12) United States Patent
McIntire

(10) Patent No.: US 8,641,266 B2
(45) Date of Patent: Feb. 4, 2014

(54) HORIZONTAL-FLOW HYDRATION APPARATUS

(76) Inventor: William Ray McIntire, Sugar Land, TX (US)

( * ) Notice: Subject to any disclaimer, the term of this patent is extended or adjusted under 35 U.S.C. 154(b) by 1315 days.

(21) Appl. No.: 12/215,525

(22) Filed: Jun. 27, 2008

(65) Prior Publication Data

US 2009/0323464 A1 Dec. 31, 2009

(51) Int. Cl.
*B01F 15/02* (2006.01)
*B01F 7/00* (2006.01)

(52) U.S. Cl.
USPC ..... 366/291; 366/270; 366/263; 366/300; 366/137

(58) Field of Classification Search
USPC ..... 366/291, 300, 137, 270, 299; 210/521, 210/513
See application file for complete search history.

(56) References Cited

U.S. PATENT DOCUMENTS

| | | | | | |
|---|---|---|---|---|---|
| 2,081,850 | A | * | 5/1937 | Darby et al. | 366/297 |
| 2,243,309 | A | | 11/1938 | Daman et al. | |
| 2,239,753 | A | * | 4/1941 | Martin | 536/76 |
| 2,573,521 | A | | 10/1947 | Wasley et al. | |
| 3,154,601 | A | | 10/1964 | Kalinske et al. | |
| 3,977,472 | A | | 8/1976 | Graham et al. | |
| 4,076,681 | A | * | 2/1978 | Boehme et al. | 523/324 |
| 4,544,032 | A | | 10/1985 | Echols | |
| 4,634,526 | A | * | 1/1987 | Salkeld et al. | 210/194 |
| 4,635,727 | A | | 1/1987 | Anderson et al. | |
| 4,687,586 | A | | 8/1987 | Argabright et al. | |
| 4,716,932 | A | | 1/1988 | Adams, Jr. | |
| 4,828,034 | A | | 5/1989 | Costien et al. | |
| 4,834,782 | A | * | 5/1989 | Silva | 95/197 |
| 5,046,856 | A | | 9/1991 | McIntire | |
| 5,316,443 | A | * | 5/1994 | Smith | 416/197 R |
| 5,501,523 | A | * | 3/1996 | Weetman et al. | 366/263 |
| 5,511,881 | A | * | 4/1996 | Post et al. | 366/263 |
| 5,653,883 | A | * | 8/1997 | Newman et al. | 210/617 |
| 6,443,613 | B1 | * | 9/2002 | Rumph | 366/348 |
| 6,817,376 | B2 | * | 11/2004 | Morgan et al. | 137/14 |
| 7,033,067 | B2 | * | 4/2006 | Sentmanat | 366/76.7 |
| 7,223,013 | B2 | | 5/2007 | Allen | |

(Continued)

*Primary Examiner* — Joseph S Del Sole
*Assistant Examiner* — Nahida Sultana
(74) *Attorney, Agent, or Firm* — L. Wayne White

(57) ABSTRACT

A novel apparatus is disclosed which comprises:
(a) pumping means for injecting a fluid through a conduit means into an inlet pipe of a fluid mixing tank,
(b) said fluid mixing tank comprising a plurality of compartments connected in series and in fluid communication with adjacent compartments in the series, and designed to provide for a horizontal flow of fluids from the first compartment to the last compartment in the series,
(c) at least one compartment being equipped with one or more radial-flow impellers connected to a vertical shaft, and means for rotating such impellers at a rate designed to stir the contents of the compartment radially with high shear and prevent fluid stagnation,
(d) at least one compartment being equipped with one or more axial flow impellers connected to a vertical shaft, and means for rotating such impellers at a rate designed to circulate the contents of the compartment vertically,
(e) the inlet pipe being designed to introduce fluids into the first compartment, and
(f) a means for withdrawing fluid from the apparatus through a discharge opening in the last compartment in the series.
The new apparatus is particularly useful as a horizontal flow hydration tank to prepare aqueous viscous fluids for use as well treatment fluids. Hydratable polymers can be hydrated rapidly and consistently in real time. The apparatus is less complex mechanically and operationally than the compartmentalized vertical-flow tanks of the prior art, and it can be constructed as a mobile unit.

17 Claims, 4 Drawing Sheets

(56) References Cited

U.S. PATENT DOCUMENTS

| | | | | |
|---|---|---|---|---|
| 7,497,263 | B2 * | 3/2009 | Parris et al. | 166/308.5 |
| 7,497,335 | B2 * | 3/2009 | Bork et al. | 209/172 |
| 7,883,263 | B1 * | 2/2011 | Wenger et al. | 366/172.2 |
| 8,061,888 | B2 * | 11/2011 | Ji et al. | 366/155.1 |
| 2004/0145966 | A1 * | 7/2004 | Kar et al. | 366/329.1 |
| 2004/0188334 | A1 * | 9/2004 | McWhirter et al. | 210/219 |
| 2004/0190371 | A1 * | 9/2004 | McWhirter et al. | 366/265 |
| 2006/0176771 | A1 * | 8/2006 | Adams | 366/270 |
| 2007/0140050 | A1 * | 6/2007 | Humphrey | 366/262 |
| 2008/0199321 | A1 * | 8/2008 | Gigas et al. | 416/223 R |
| 2009/0114035 | A1 * | 5/2009 | Lehnert | 73/861 |
| 2009/0310437 | A1 * | 12/2009 | Pappalardo | 366/337 |

* cited by examiner

HORIZONTAL-FLOW HYDRATION APPARATUS

CROSS-REFERENCE TO RELATED APPLICATIONS

Not Applicable

STATEMENT REGARDING FEDERALLY FUNDED RESEARCH AND DEVELOPMENT

Not Applicable.

INCORPORATION BY REFERENCE OF MATERIAL SUBMITTED ON A COMPACT DISC

Not applicable.

BACKGROUND OF THE INVENTION

1. Field of the Invention

This invention relates generally to a horizontal-flow hydration apparatus and a method of using such equipment to make hydrated polymers and viscous aqueous fluids containing such hydrated polymers. Such viscous fluids are widely used in the oilfield service industry as a primary component in fracturing fluids, acidizing fluids and gravel packing fluids. The invention is particularly useful in making hydrated viscous fluids in a continuous-mix process for fracturing fluids.

2. Description of Related Art

The oilfield service industry uses viscous fluids extensively in treating subterranean earth formations to stimulate the production of oil and gas (i.e., natural gas) from the formation. Examples of such treatment include fracturing, acidizing and enhanced oil recovery. The industry also uses such viscosified fluids in operations to complete the well, such as gravel packing.

The polymers used to prepare such fluids are well known. The class of polymers has many members, all of which are hydratable. The most widely used polymers are guar (aka guar gum) and derivatives of guar, such as hydroxypropylguar ("HPG"), carboxymethylhydroxypropylguar ("CM-HPG"), and the like. Guar is a long-chain, high molecular weight polymer composed of mannose and galactose sugars, and is therefore a polysaccharide. Other polymers include, by way of example and without limitation, polyacrylamide, acrylamide copolymers and derivatives of such polyamides.

Water-based fracturing fluids thickened with guar have been used since the late 1950s. It is estimated that today more than two-thirds of the fracturing treatments that use water-base gels are viscosified with guar or HPG. The polymers are typically sold as dry powders (i.e., as dry particulate solids) in containers of convenient size. Bags of polymer weighing 50 pounds or "supersacks" weighing 2 to 3 thousand pounds are commonly used. The polymers have also been supplied as a slurry in a non-aqueous medium. As used herein, the term "slurry of a hydratable polymer" shall mean a pumpable slurry comprised of a hydratable polymer dispersed in a hydrophobic fluid, such as diesel.

Historically, the viscous fluids have been prepared on site in batch-mix operations or in continuous-mix operations. Previous commercial mixing procedures encountered various problems. For example, even the logistics of providing large volumes of fluid to well sites, which for some reason generally seem to be at some "remote" location, in consistent quality and quantity are daunting. Mixing dry additives (including hydratable polymers) with water or other aqueous fluids is problematic and special equipment and operating procedures are generally required to avoid chemical dusting, uneven mixing, lumping or gels. Extended preparation and mixing time are involved. Furthermore, with respect to batch-mix operations, job delays can result in the deterioration of pre-mix gels of the hydratable polymers, especially guar and guar derivatives, and the potential loss of the time and materials incurred in preparing the gels. Batch operations also suffer chemical losses due to tank bottoms and costs associated with pre-treatment and post-treatment tank clean-up. For these and other reasons, the industry has evolved to a preference to continuous-mix operations, especially for fracturing treatments. The slurries of hydratable polymers mentioned above are especially well adapted for use in continuous-mix operations.

U.S. Pat. No. 4,828,034, entitled "Method of Hydrating Oil Based Fracturing Concentrate and Continuous Process Using Same," by Vernon G. Constein and Harold D. Brannon, described one method of mixing a fracturing fluid slurry concentrate comprising a dispersed hydratable polymer (e.g., HPG) and a hydrophobic solvent base (e.g., No. 2 diesel) on a real time basis during the fracturing treatment of a subterranean formation. The process was said to produce a fully hydrated fracturing fluid in a continuous operation without the use of large volume storage/hydration tanks.

U.S. Pat. No. 5,046,856, entitled "Apparatus and Method for Mixing Fluids," by William R. McIntire, described a novel apparatus and method that advanced the technology over U.S. Pat. No. 4,828,034. In the '856 patent, a slurry concentrate was dispersed in water and the resulting fluid passed through a series of interconnected vertical tanks, at least one of which sheared the polymer slurry and water feed with a radial flow impeller positioned parallel to an axial fluid flow path. The process was said to provide a "plug flow" of materials through the plurality of vertical tanks and to effect complete hydration of the hydratable gel for use in well treatment operations. This process was subsequently referred to by McIntire and the patent assignee, Dowell Schlumberger Inc., as the "Precision Continuous Mix Process" or "PCM Process."

U.S. Pat. No. 7,223,013, entitled "First in First out Hydration Tanks," by Thomas E. Allen, described a design for a hydration tank that allegedly reduced the amount of stagnation that can occur in hydration tanks. This can be a problem when attempting to hydrate polymers such as guar and HPG, even in the PCM Process of McIntire. The partially hydrated polymers are not Newtonian fluids and they tend to form "channels" while passing through the hydration tanks. The less viscous fluids entering the tank tend to bypass the more viscous fluids through channels of least resistance. As Allen states, if the fluid is not managed properly, parts of the tank will become gelled and motionless and will be difficult to get moving again. When gelation occurs, the gelled fluid remains in one place and the newly mixed fluids that enter the tank will bypass the gelled fluid. Thus, the tank is functionally smaller than its actual size since part of the fluid in the tank is not moving.

J. E. Brown et al., Schlumberger Dowell, published a paper entitled "Fracturing Operations" in the text "Reservoir Stimulation," Third Edition (2000), edited by Michael J. Economides and Kenneth G. Nolte, John Wiley & Sons, Ltd., page 11-23, which stated: Process-controlled blending equipment that meters and continually mixes polymer slurry, concentrated potassium chloride solution and liquid additives has made continuous-mix operations a viable alternative to batch-mix operations. There are several advantages to performing a fracture treatment in continuous-mix mode. Environmental concerns are greatly reduced because only freshwater residuals remain in the fracture tanks after a treatment. Besides eliminating the cost of gelled tank bottom, no tank cleaning or disposal costs are incurred. In addition, a more predictable and consistent viscosity is obtainable for large treatments, where bacteria can degrade the gel viscosity of a batch-mixed fluid before pumping begins. Personnel time and costs can also be greatly reduced. The continuous-mix process eliminates the need to have gelling crews precede fracturing operations, resulting in direct savings in time for personnel and equipment. Finally, viscosities can be easily changed throughout the treatment. This allows tapering the polymer loading so that fluid damage to proppant conductivities can be minimized or a net pressure limitation can be met.

To ensure that a continuous-mix operation goes smoothly, several requirements must be observed. The polymers should be metered accurately either as dry powders or powders slurried in a carrier fluid. The polymers should be thoroughly dispersed in the water either by educting the dry polymer powder into the water stream or injecting the slurried polymer powder into the water stream and providing agitation to disperse the slurry in the water. Specialized mixing and hydration units should provide the metering capabilities, proper shear environment a sufficient residence time for proper hydration. The hydration process related time and shear has proved to be extremely important for continuous-mix treatments. If the base fluid has not progressed sufficiently in the hydration process before the liquid is crosslinked, the fluid will have decreased viscosity and may experience stability problems.

The hydration process requires time. Batch mixing tests of the hydration process show that adding high-shear mixing accelerates the process of hydration. The process is also temperature dependent, with lower fluid temperatures slowing the process. The time required for hydration of powdered guar, either dispersed in a carrier fluid to be injected into the aqueous stream or dispersed directly as a dry powder into the aqueous stream through an eductor or other means, is typically on the order of a few minutes. Fracturing treatments for oil and gas wells require high pump rates, typically 20 to 100 barrels per minute. Large volume hydration tanks are required to provide adequate residence time for hydration at those rates.

Fracturing operations involve mobile equipment taken from wellsite to wellsite. Such equipment is normally transported on the public roadways, and thus requires equipment sizes and configurations in compliance with Federal and State Departments of Transportation rules and regulations. Size and weight restrictions place critical limitations on equipment design. Space for hydration tanks on trailers meeting such standards is limited, and it is advantageous to provide hydration equipment that makes optimum use of the space available.

It is common, but incorrect, to assume that the residence time for fluid flowing through a tank with volume, V, is given by that volume divided by the fluid flow rate, Q. That calculation is correct for the average residence time, but is not correct for each incremental volume of fluid, unless the fluid flow through the tank is "first-in-first-out" (FIFO), also referred to as "plug-flow". While near FIFO conditions can be achieved under conditions of turbulent flow in a pipe, that condition does not happen in large volume tanks. Even under conditions of turbulent flow, eddy currents develop in large tanks; such eddy currents partially stagnate portions of the tank volume and lead to a spread in residence times (or "ages") of different incremental fluid volumes exiting the tank. The spread in the residence times can cause the various incremental volumes of fluid to have quite different properties, especially for the viscous fluids thickened with guar or guar-based materials.

Fluids used for oil and gas well fracturing treatments ("fracturing fluids") made from polymers suspended in water, have distinct rheological characteristics which make achieving FIFO conditions in a large tank essentially impossible. These fluids suppress turbulence through interactions of the suspended long-chain polymers. When the polymers are hydrated and turbulence is suppressed, flow in the tanks is in the laminar regime, developing velocity gradients and stable flow streams. These fracturing fluids are shear thinning; their viscosities decrease with shear. If a portion of the fluid in a tank is moving slowly, bypassed by the main stream of fluid, the slow moving fluid in its low shear environment has higher viscosity. This tends to slow the fluid further and stabilize stagnated regions of the tank. Eddy formation also results in slower moving fluid which has higher viscosity and tends to stabilize the eddy.

Different residence times for fluids is a problem particularly at start-up times. Young, partially hydrated fluid entering a tank of older, more hydrated fluid will have a lower viscosity and will tend to stay segregated from the more viscous fluid. The newly injected fluid channels through the more viscous fluids in the tank and exits after much less than the average residence time. This is particularly problematic when the tank contains fully hydrated fluid before a fracturing treatment begins or when the fracturing treatment has been stopped for a period of time and restarted. Fracturing treatments can be interrupted for a variety of operational causes or by the operator wishing to change the treatment procedure.

The hydration of polymer is not a linear function of time, but starts rapidly and proceeds more and more slowly as it approaches full hydration. This results in lower average viscosity of the discharge fluid than one would calculate using the hydration kinetics for a batch process and the average residence time in the tank. The loss in viscosity for a volume of fluid exiting the tank at less than the average residence time is greater than the increase in viscosity for a similar volume of fluid exiting after a longer than average residence time. The low viscosity of young exiting fluid is not compensated by the slightly higher viscosity of old exiting fluid.

To produce well-hydrated fluid on mobile equipment at the high pump rates required for fracturing treatments, it is advantageous to provide the high-shear conditions required to accelerate the hydration process and to control the flow of hydrating fluid through a large tank volume so that all volumes of fluid passing through the tank have sufficient residence times in the tank to fully hydrate. Without adequate control of the fluid flow, larger tank volumes are required to ensure adequate residence time for all the fluid, and even this may not be adequate if portions of the fluid are stagnant.

The hydration tanks described in U.S. Pat. No. 4,828,034 and U.S. Pat. No. 5,046,856 are vertical-flow compartmentalized tanks with generally vertical flow paths over and under walls separating tank compartments have several disadvantages compared to a horizontal-flow tank. Flow into the compartmentalized tank comes initially from a centrifugal pump. After that, flow from compartment to compartment is by gravity. Half the passages are over weirs between compartments and the other half through passages near the tank bottom. When discharge rates increase, the last (discharge) compartment level will drop until sufficient fluid head differences exist across all passages to force fluid to flow through the tank at the increased rate. The resulting delay in response to rate changes makes level control difficult.

On fracturing treatments it is essential that fluid flow be maintained to equipment downstream of the hydration unit at all times. When there is an interruption to the input flow to a vertical-flow compartmentalized tank, the tank level drops. Only the volume in the last compartment is available to be discharged to the equipment downstream. In a horizontal-flow compartmentalized tank, the entire volume of the tank is available for discharge in the case of inlet supply interruption. In the case of a brief inlet supply interruption, it is difficult to "catch up" by increasing the inlet rate to a vertical-flow compartmentalized tank. Each compartment must be filled to a level at which it flows to the next compartment at a rate required to exceed the discharge rate and refill the tank. Fluid flow to the last (discharge) compartment does not increase until fluid volumes in each of the upstream compartments are increased sufficiently to raise the flow rate through the tank. At high flow rates, significant drops in fluid level occur between compartments from the first compartment to the last. This reduces the effective volume of the tank for high rates at which lower residence time exists, and reduces that residence time further. Lastly, there is no natural flow path between pairs of compartments in such vertical-flow tanks. To empty the hydration tank at the end of a job requires valves and/or piping between pairs of compartments. This adds mechanical and operational complexity.

If hydration performance were not an issue, field operations personnel would prefer a horizontal-flow compartmentalized tank over a vertical-flow compartmentalized tank.

Some horizontal-flow compartmentalized hydration units have been built with long horizontal channels separated by vertical walls from the front of the tank to the rear. When water flows through those channels at fracturing operation rates, Reynolds numbers are high, and it appears that the flow of water down the channels could provide a reasonably FIFO flow stream. However, when pumping viscosified fluids with the turbulence suppressing characteristics of typical fracturing fluid polymers, laminar flow profiles develop in the channels. This leads to several problems: Large eddies are formed, thick fluid stagnates in portions of the tank, and less-hydrated fluid from the inlet channels through the tank to the discharge. This channeling reduces the degree of hydration and the viscosity of the discharge fluid. The lack of high shear mixing to accelerate hydration kinetics results in poor hydration unit performance of these horizontal-flow compartmentalized hydration units, especially at polymer concentrations normally required in hydraulic fracturing fluids.

Even though there have been many modifications in equipment and procedures to hydrate polymers for use as viscosified aqueous fluids in oilfield applications, a need still exists for an apparatus and method that can hydrate the polymers rapidly and consistently in real time. This is one of the objects of this invention.

Another object of this invention is to provide a horizontal-flow hydration tank that is less complex mechanically and operationally than the compartmentalized vertical-flow tanks. It is also anticipated that the present invention will permit the user to reduce the variable costs associated with making and using a viscosified fluid in fracturing treatments and other oilfield procedures to treat subterranean formations. That is, variable costs such as mixing and blending charges, transportation, storage and disposal charges, and power requirements should be reduced.

BRIEF SUMMARY OF THE INVENTION

A novel apparatus has now been discovered which comprises:

(a) pumping means for injecting a fluid through a conduit means into an inlet pipe of a fluid mixing tank, (b) said fluid mixing tank comprising a plurality of compartments connected in series and in fluid communication with adjacent compartments in the series, and designed to provide for a horizontal flow of fluids from the first compartment to the last compartment in the series, (c) at least one compartment being equipped with one or more radial-flow impellers connected to a vertical shaft, and means for rotating such impellers at a rate designed to stir the contents of the compartment radially with high shear and prevent fluid stagnation, (d) at least one compartment being equipped with one or more axial flow impellers connected to a vertical shaft, and means for rotating such impellers at a rate designed to circulate the contents of the compartment vertically, (e) the inlet pipe being designed to introduce fluids into the first compartment, and (f) a means for withdrawing fluid from the apparatus through a discharge opening in the last compartment in the series.

The new apparatus is particularly useful as a horizontal flow hydration tank to prepare aqueous viscous fluids for use as well treatment fluids. Hydratable polymers can be hydrated rapidly and consistently in real time. The apparatus is less complex mechanically and operationally than the compartmentalized vertical-flow tanks of the prior art. The apparatus can be constructed as a mobile unit or a stationary unit.

The apparatus is preferably constructed to be substantially rectangular in shape, from a top view. The compartments of the apparatus are also beneficially and preferably constructed to be substantially square or rectangular in shape, from a top view. The compartments have a width of about four (4) feet and a length of from about four (4) to about six (6) feet. The apparatus generally has at least four (4) compartments in series, preferably at least six (6) compartments, and most preferably at least eight (8) compartments in series. The compartments in the apparatus can be arranged to convenience, but they are generally arranged in a line or in a side-by-side configuration, as illustrated in the attached Figures. The tank compartments are connected in series and are in fluid communication with adjacent compartments in the hydration tank. The compartments are preferably separated by vertical partitions that have a vertical opening from bottom to top of the compartments. The first compartment in the series, compartment 1, and the last compartment have one such vertical opening, while the other compartments have two (2) such vertical openings located diagonally opposed to each other.

The apparatus subjects the aqueous fluids containing hydratable polymers to zones of high-shear mixing and zones of vertical axial flow. This promotes rapid hydration of the polymer, and helps eliminate stagnant fluid in the compartments. The full volume of the tank can thus be used effectively. The process also reduces channeling of fluids through the tank and helps reduce differences in residence times.

BRIEF DESCRIPTION OF THE DRAWINGS

The invention will now be described in greater detail and with reference to the accompanying drawings forming a part of this specification and in which:

FIG. 1 illustrates a top view of a prior art horizontal-flow hydration that.

DETAILED DESCRIPTION OF THE INVENTION

Figure 1:
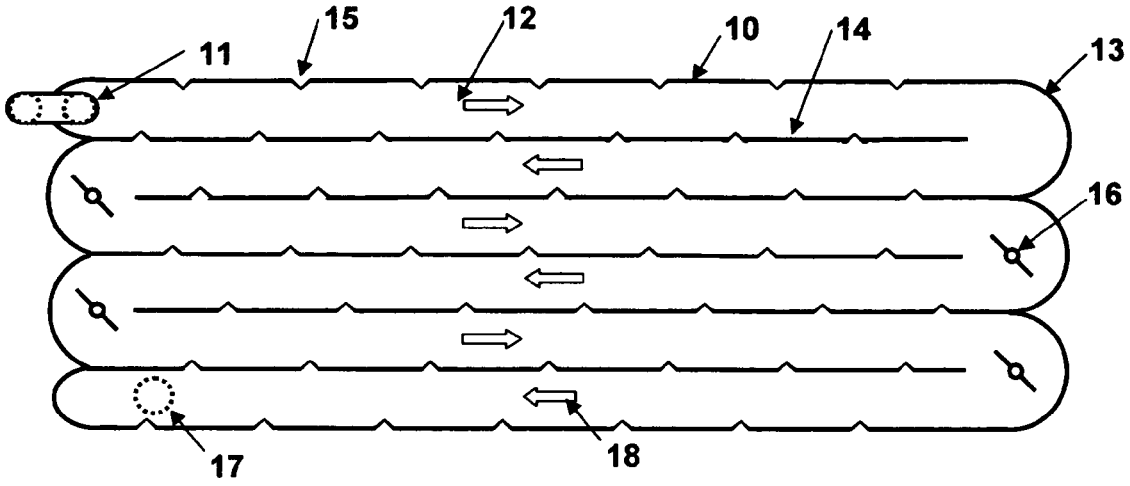
Fig. 1 Prior Art

FIG. 1 illustrates a prior art horizontal-flow hydration tank 10. The tank is mounted on a trailer (not shown) to provide mobility for treating oil and gas wells. On one side of the trailer is a suction manifold leading to a centrifugal pump (not shown) that pumps water from frac tanks to the hydration tank through inlet pipe 11. Polymer powder slurried in diesel or other oil is injected into the water stream just upstream of the centrifugal pump. Turbulence in the pump and in piping between the pump and the hydration tank disperses the polymer slurry into the water stream. Water into which slurried polymer has been dispersed is pumped into the hydration tank through an inlet pipe 11 at the beginning of a long serpentine path through the tank. The hydration tank is divided into seven (7) long flow channels 12 from the top of the tank to the bottom that extend the entire length of the tank. Arrows 18 on the figure indicate the direction of fluid flow along the channels. Semicircular tank wall sections 13 provide structural strength to the ends of the tank and promote smooth flow around the ends of the channel dividing walls 14. Structural strength is provided for the side tank walls and channel dividing walls by a series of vertical corrugations 15 that run the entire height of the walls. Four vertical, hydraulically driven impeller shafts at turning points in serpentine path turn impellers with flat vertical paddle blades 16 at approximately 60 RPM. There are two impellers on each mixer shaft. At the end of the serpentine path, there is a discharge opening 17 in the bottom of the tank with a pipe leading to a discharge manifold.

When plain water is pumped through the hydration tank in FIG. 1 at typical fracturing rates, flow through the tank is in turbulence. Turbulent flow along the narrow channels provides a good age distribution for the fluid exiting the tank. This is analogous to turbulent flow in a pipe producing a nearly FIFO condition. However, when fracturing fluids viscosified with polymers are pumped, the turbulence suppressing nature of the long-chain hydrated polymers changes the flow regime to laminar flow. Flow velocity profiles develop, as well as eddies created by fluid interacting with the corrugations 15. Under laminar flow conditions, some fluid is delayed passing through the tank and some fluid channels through in less than the average residence time. Fluid stagnates in the top of the tank particularly in the last channels as the polymer hydrates and the fluid thickens.

The vertical paddle blade mixers 16 at the ends of channels have relatively small diameters and turn relatively slowly. They do not provide high-shear mixing to accelerate hydration of the polymer. Other problems with the prior art hydration tank are typically encountered at the end of the job. Such problems include difficulty in cleaning the walls of the channels and the collection and disposal of the accumulation of polymer and the oil from the slurried polymer floating on top of the quiet water above the discharge opening 17.

Figure 2:
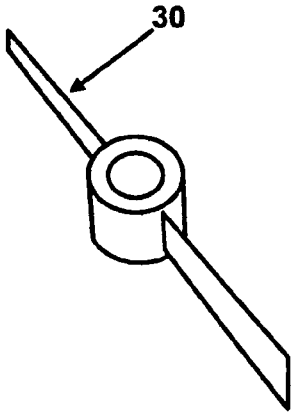
FIG. 2 illustrates a straight-blade mixing impeller used in the prior art hydration tank.

FIG. 2 illustrates a mixer impeller of the type used in the prior art tank of FIG. 1. It is a radial-flow impeller with flat vertical blades 30. Turning at low speeds, such as 60 RPM, the impellers provide some fluid mixing at the ends of flow channels, but provide little acceleration to the hydration process and have little effect on the laminar flow of fracturing fluids flowing through the channels of the hydration tank of FIG. 1.

Figure 3:
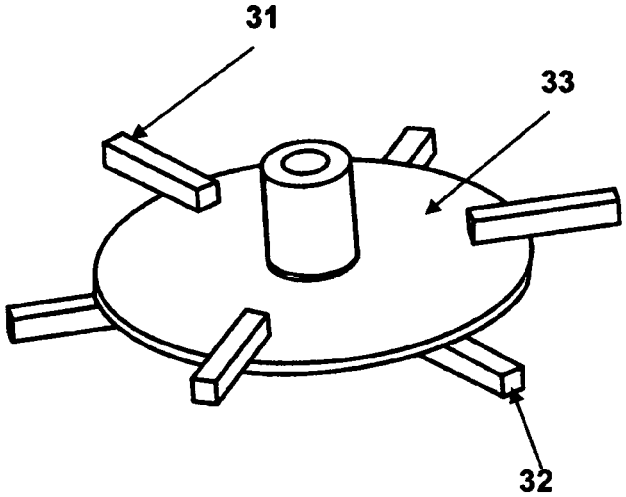
FIG. 3 illustrates a bar turbine, one type of radial-flow impeller.

FIG. 3 illustrates a typical bar turbine, a type of radial-flow impeller. As described in U.S. Pat. No. 5,046,856, Apparatus and Method for Mixing Fluids, by William R. McIntire, which is incorporated herein by reference, bar turbines are advantageously used in hydrating polymers because they can be used to provide high-shear mixing to accelerate polymer hydration. In addition, such bar turbines can provide enough pumping to circulate hydration tank compartments without creating large vortex flow and overflowing the tank. The bar turbine in FIG. 3 has three bars 31 above the central circular disk 33 and three bars 32 below the disk. Other versions of bar turbines have different numbers of blades. Such bar turbines are useful in the present invention.

Figure 4:
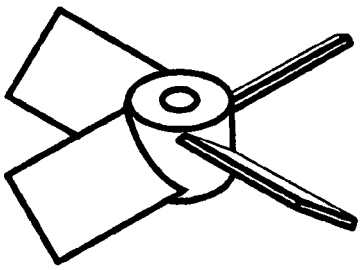
FIG. 4 illustrates an axial-flow impeller

FIG. 4 illustrates one type of axial-flow impeller. The impeller in FIG. 4 has blades that are straight, flat and inclined. This impeller type has lower pumping efficiency than other types of axial-flow impellers with curved blades, such as propellers, but the impeller shown in FIG. 4 is much less costly to manufacture. Hydration units in the oilfield generally have excess horsepower available for running hydraulic motors, so the pumping efficiency of the axial-flow impellers is not an important consideration. Other types of axial-flow impellers can perform adequately in the present invention.

Figure 5:
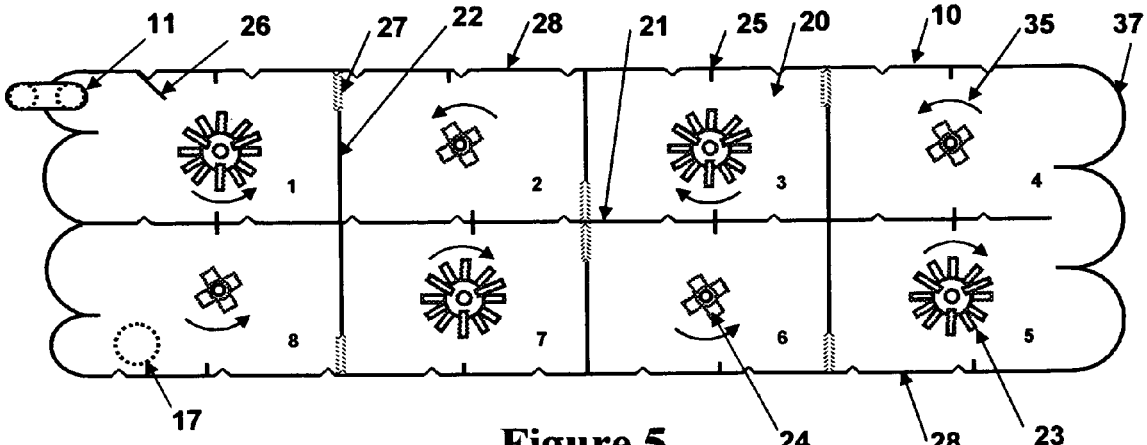
FIG. 5 illustrates an embodiment of the invention.

FIG. 5 illustrates an embodiment of the present invention. The length of tank 10 is increased by about 20% over the prior art design in FIG. 1 to increase the tank volume and average residence time. The tank is divided into eight (8) generally rectangular compartments 20, numbered 1 though 8 in the figure, by a center wall running the length of the tank 21 and by vertical dividing partitions (partial walls having a vertical opening from the top to the bottom of the compartment) 22.

Figure 9:
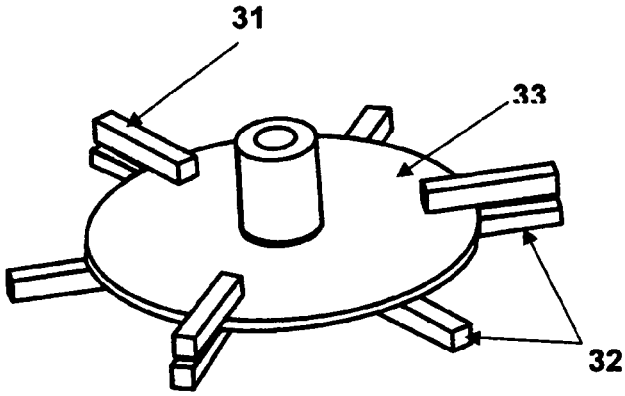
FIG. 9 illustrates a bar turbine with additional bars below the central disk.

Two types of mixing impellers are used in the hydration tank of FIG. 5. In each odd-numbered compartment a single hydraulically driven, vertical mixer shaft turns a pair of bar turbine impellers 23. Flow patterns set up in the odd-numbered compartments generally segregate each compartment into an upper and a lower mixing zone. The large diameter radial-flow impellers are bar turbines. These turbine mixers are preferred because they use horsepower efficiently for the hydration process. They provide enough pumping action to stir their mixing zones and prevent fluid stagnation, without creating too much vortexing, and they provide high-shear mixing with high impeller tip speeds to accelerate the hydration process. The bar turbine impellers used in FIG. 5 are illustrated in FIG. 9. They were similar to the bar turbine shown in FIG. 3 in that they had three bars 31 above the central circular disk 33 but they have six bars 32 below it (rather than three). The three additional bars below the disk are positioned directly below the three bars above the disk. The additional bars below the central disk increase the power dissipated in high-shear fluid mixing in the vicinity of the impeller, without increasing the overall agitation of the top portion of the tank compartment.

In each even numbered compartment, a vertical hydraulically driven mixer shaft turns a single axial-flow impeller 24. The axial-flow impellers pump fluid upwards to prevent channeling flow along the bottom of the tank bypassing the top half of the tank. Any of a variety of axial-flow impeller designs could be effective in this application. Multiple axial-flow impellers on the mixer shaft can be used, but the single simple impeller shown in the present configuration performs adequately.

Arrows 35 show the directions of rotation of the mixer shafts. Vortex breaking bars 25 on the center tank wall 21 and outer walls 28 prevent development of large vortexes in the compartments. Large vortexes would raise the fluid level along the outside tanks walls and require running the tank at an overall lower fluid level. Lowering the tank level decreases the occupied volume of the tank and the average fluid residence time. In addition to their radial- or axial-flow components, both types of impellers set up a generally circular fluid rotation about the mixer shafts in the direction of the spinning impeller. The mixer directions are set to make the circular rotation oppose the direction of the fluid flowing into the compartment. This promotes mixing of incoming fluid with the fluid in the compartment. It also decreases vortex formation in the top of the tank compartments.

Inlet fluid from the centrifugal pump (not shown) comprising dispersed polymer slurry in water flows into the first compartment through the inlet pipe 11. Vertical baffle 26 redirects the inlet flow stream toward the mixer shaft to prevent the fluid short-circuiting the first compartment and going directly to the compartment exit opening 27 against the outside tank wall 28. The exit opening 27 of each compartment is a vertical opening approximately 12 to 14 inches wide. The fluid path through the tank compartments is generally horizontal, and flow through each compartment exit is generally uniform from top to bottom.

Figure 6:
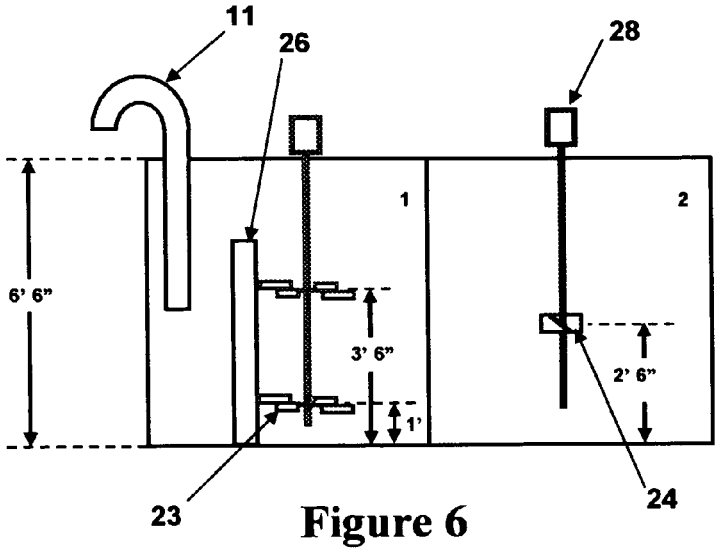
FIG. 6 illustrates a side view of compartments 1 and 2 in the hydration tank of FIG. 5.

FIG. 6 illustrates a cross section side view of tank compartments 1 and 2, looking through tank compartments 7 and 8. The height of the compartments in the hydration tank is 6.5 feet. Inlet pipe 11 discharges the polymer dispersed in water vertically downward into the outer front corner of the tank as shown in FIG. 1. Baffle 26 serves to redirect the stream of fluid generally toward the mixer shaft in the center of the compartment to prevent the inlet fluid going directly to the passageway 27 from compartment 1 to compartment 2. Two radial-flow bar turbine impellers 23 on a common shaft in compartment 1 segregate that compartment into top and bottom mixing zones with high shear mixing. The vertical shaft is located in the center of the compartment. The lower impeller is located one foot above the bottom of the tank, and the upper impeller is located 2.5 feet above the lower one. Both impellers 23 are 2 feet in diameter. The impellers are powered by a hydraulic motor 28 and turn at approximately 175 to 200 RPM.

The axial-flow impeller 24 on a vertical shaft in compartment 2 is of simple design to reduce manufacturing expense. The mixer shaft is located in the center of tank compartment 2 as seen in FIG. 5, and the impeller is positioned 2.5 feet above the bottom of the tank. Impeller 24 is configured, and turned in a direction, to pump fluids upwards to provide vertical mixing for the fluid within tank compartment 2.

Figure 7:
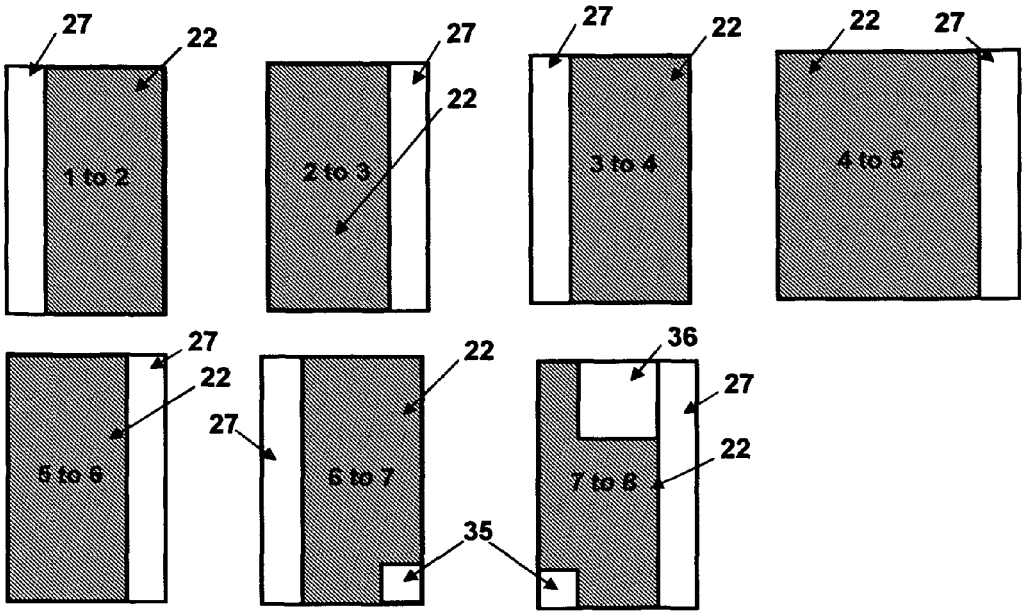
FIG. 7 illustrates the vertical walls separating adjacent compartments in the hydration tank of FIG. 5.

FIG. 7 illustrates the vertical partitions between sequential tank compartments 22 and the vertical flow openings 27 between compartments. All partitions are shown as seen from the right hand side of the FIG. 1, except the wall between compartments 4 and 5. The wall between compartments 4 and 5 is shown as seen from the bottom of the FIG. 1. The shaded portions represent the walls, and the unshaded portions represent open flow areas connecting the compartments.

Generally the flow areas connecting compartments are vertical openings 27 approximately 12 to 14 inches wide from the bottom to the top of the tank. These wide spaces allow fluids to flow horizontally through the tanks at high flow rates with only small pressure drops or hydraulic head losses between compartments. This is advantageous because it allows the operator to maintain fluid levels in compartment 1 at a level slightly below the top of the tank to prevent overflowing and to have compartment 8 nearly full as well, thus utilizing nearly the entire volume of the tank.

When emptying the tank at high pump rates at the end of a fracturing treatment, the compartment fluid levels drop and the flow areas between compartments decrease. Increased flow velocities between compartments increase the fluid head losses between compartments as the average tank level drops. The fluid level in each tank compartment drops below the levels in the compartments upstream. The additional one-foot by one-foot openings 35 in the bottom of partitions 22 between compartments 6 and 7 and compartments 7 and 8 provide additional flow area to decrease hydraulic head losses and maintain a higher fluid level in compartment 8 as the tank empties. Those additional flow areas are small compared to the flow areas available when the tank is nearly full. They do not significantly compromise the separation of those compartments under normal operating conditions.

The added opening 35 in the bottom of the partition between compartments 7 and 8 has a second purpose. When compartment 8 is nearly empty, flow into that compartment through the tall vertical opening has high velocity through a small flow area defined by vertical opening width and the fluid level. In the absence of the added opening 35, the fluid velocity along the outer wall of the tank sets up a vortex near the fluid discharge opening. This leads to air entrainment in the discharged fluid and problems for equipment downstream. Adding the foot-square opening at the bottom of the partition opposite the tall vertical opening balances flow when the tank is nearly empty by providing two comparable flow streams that interact to eliminate vortex formation.

The top of the partition between compartments 7 and 8 has an additional opening 36, with approximate dimensions of 2 feet by 2 feet. The normal operating fluid level in tank compartment 1 is generally a half foot to a foot below the top of the tank. The operating fluid level is about 3 or 4 inches lower in compartment 8 than in compartment 1. Opening 36 in the partition gives an effective flow path two feet wide and approximately one foot deep at the top of the fluid level. The axial-flow impeller in compartment 8 pumps fluid upward in compartment 8. Fluid flows back upstream into compartment 7 through opening 36 in the wall, in addition to flowing backwards through the top of the vertical opening 27. Pumping fluid from compartment 8 back into the top of compartment 7 combines the volumes of those compartments into one large mixed compartment. This avoids fluid stagnation in the top of compartment 8 and the loss of effective tank volume for hydrating the fluid. An improvement over the hydration unit illustrated in the figure can be achieved by increasing the upwards pumping of the axial-flow impeller in compartment 8. This can be accomplished by increasing the diameter or speed of the single impeller or adding an additional axial-flow impeller to the mixer shaft in compartment 8.

Figure 8:
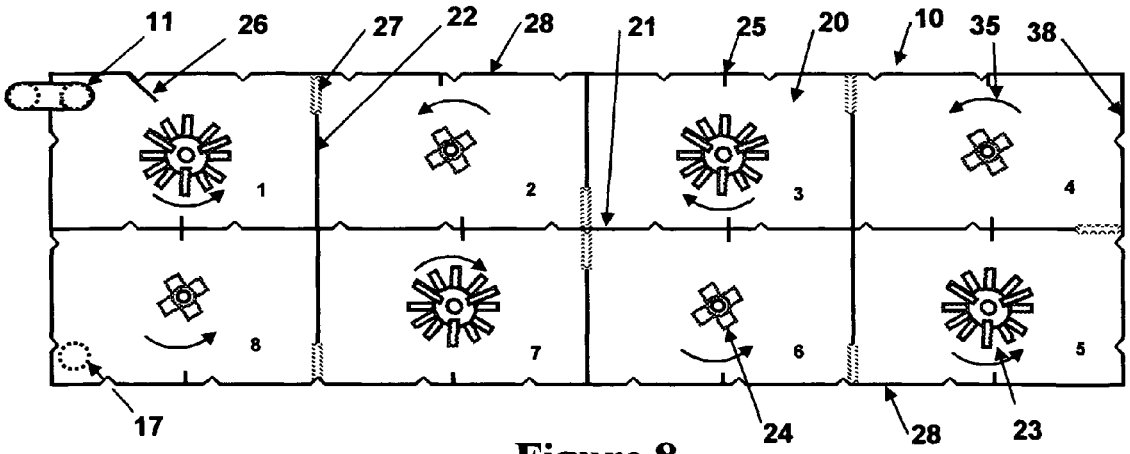
FIG. 8 illustrates an embodiment of the invention as a rectangular hydration tank.

FIG. 8 illustrates a proposed hydration tank design based on a rectangular tank rather than the modified tank used for the prototype. In addition to the straight walls at the ends of the tank, there is one other change required for optimum performance. The semicircular shape of the back tank wall 37 in FIG. 5 redirects fluid flowing through the opening between compartments 4 and 5 and makes the fluid flow along the middle tank wall 21 in compartment 5. Mixer 23 in compartment 5 of FIG. 5 turns clockwise to make the vortex flow pattern in the compartment oppose the direction of the incoming fluid. With the straight tank end wall 38 in FIG. 8, the direction of the mixer in compartment is changed to counterclockwise to make the vortex flow in compartment 5 oppose the direction of fluid flow into that compartment.

An embodiment of the present invention is made by retrofitting a commercial unit of the type shown in FIG. 1 to make it conform with FIGS. 5 and 6, with impellers illustrated in FIGS. 4 and 9. Field test results show improvement in hydration performance of the unit corresponding to the present invention. Viscosities of the field samples are measured immediately after sampling and then again after the hydration process is complete (after 30 minutes). The percent hydration of the fluid sample is the ratio of it's initial and final viscosities. The embodiment of the present invention produces fluids with significantly higher initial percentage hydration while operating with colder water and at much higher pump rates. Field test results are shown in table 1 below.

TABLE 1

Comparison of Original and Modified Horizontal-Flow Hydration Units

| Unit | Volume | Fluid Temp. | Pump Rate | % Hydration |
|---|---|---|---|---|
| Horizontal-Flow Channels | 160 BBL | 78 Deg. F. | 30 BPM | 87% |
| 8 Mixed Compartments | 190 BBL | 70 Deg. F. | 70 BPM | 96% |
| 8 Mixed Compartments | 190 BBL | 72 Deg. F. | 70 BPM | 97% |

I claim:

1. A horizontal flow apparatus comprising:

(a) pumping means for injecting a fluid through a conduit means into an inlet pipe of a fluid mixing tank, (b) said fluid mixing tank comprising a plurality of compartments connected in series and in fluid communication with adjacent compartments in the series, and designed to provide for a horizontal flow of fluids through each of the compartments from the first compartment to the last compartment in the series, wherein each compartment is separated from the following adjacent compartment in the series by a common vertical wall/partition forming a vertical opening between such adjacent compartments which extends from the bottom of such adjacent compartments to the top and functions as a vertical flow opening, and a common exit/entrance, between such adjacent compartments, (c) at least one compartment being equipped with one or more radial-flow impellers connected to a vertical shaft, and means for rotating such impellers at a rate designed to stir the contents of the compartment radially with high shear and prevent fluid stagnation, (d) at least one compartment being equipped with one or more axial flow impellers connected to a vertical shaft, and means for rotating such impellers at a rate designed to circulate the contents of the compartment vertically, (e) the inlet pipe being designed to introduce fluids into the first compartment, and (f) a means for withdrawing fluid from the apparatus through a discharge opening in the last compartment in the series.

2. The apparatus defined by claim 1 wherein the compartments of said fluid mixing tank that are in fluid communication with each other are separated by vertical partitions having a vertical opening from the bottom to the top of the compartments.

3. The apparatus defined by claim 2 wherein the first compartment and the last compartment in the series have one such vertical opening, and wherein each of the other compartments in the series have two such vertical openings located diagonally opposed to each other.

4. The apparatus defined by claim 2 wherein vertical openings are diagonally opposed to each other.

5. The apparatus defined by claim 1 wherein the apparatus is generally rectangular in shape, from a top view.

6. The apparatus defined by claim 5 wherein each of the compartments is generally square or rectangular in shape, from a top view, and each compartment has essentially the same internal dimensions with a width of about four (4) feet and a length of from about 4 to about 6 feet, and essentially the same volume.

7. The apparatus defined by claim 5 wherein the apparatus is divided substantially in half by an internal longitudinal wall with a series of at least two (2) compartments being on both sides of said internal wall, the first and last compartment being located at a proximate end of the wall, adjacent to each other but on opposite sides of the internal wall.

8. The apparatus defined by claim 7 wherein the apparatus has a series of at least three (3) compartments on both sides of said internal wall.

9. The apparatus defined by claim 1 wherein the compartments alternate between having impellers that circulate the contents of the compartment vertically and impellers that circulate the contents of the compartment radially.

10. The apparatus defined by claim 1 wherein the impellers that circulate the contents of the compartment radially are large diameter impellers having a diameter of from about one-third (⅓) to two-thirds (⅔) the width of the compartment.

11. The apparatus defined by claim 10 wherein the diameter of the impellers is about one-half (½) the width of the compartment.

12. The apparatus defined by claim 1 wherein the plurality of shafts for the impellers are connected to individual hydraulic motors driven by a common power means.

13. The apparatus defined by claim 12 wherein said power means is a hydraulic drive system.

14. The apparatus defined by claim 8 wherein the compartments alternate between having impellers that circulate the contents of the compartment vertically and impellers that circulate the contents of the compartment radially, and wherein the impellers that circulate the contents of the compartment radially are large diameter impellers having a diameter of from about one-third (⅓) to two-thirds (⅔) the width of the compartment, and wherein the plurality of shafts for the impellers are connected to individual hydraulic motors driven by a common power means.

15. The apparatus defined by claim 14 wherein said apparatus has a total of eight (8) compartments, and wherein said inlet pipe protrudes into compartment 1 and introduces fluids vertically downwardly into the compartment, and wherein compartment 1 has a baffle that directs such introduced fluids towards the bottom center of the tank and away from the vertical opening between compartments 1 and adjacent compartment 2.

16. The apparatus defined by claim 1 wherein said apparatus is a mobile unit.

17. The apparatus defined by claim 15 wherein said apparatus is a mobile unit.

* * * * *